US006358084B1

(12) United States Patent
Rieger et al.

(10) Patent No.: US 6,358,084 B1
(45) Date of Patent: Mar. 19, 2002

(54) SHORTING CONTACT SUPPORT FOR IGNITER RECEPTACLES

(75) Inventors: Klaus Rieger, Igensdorf; Bernhard Kuhnel, Altdorf, both of (DE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/626,723

(22) Filed: Jul. 27, 2000

(30) Foreign Application Priority Data

Jul. 30, 1999 (DE) ..... 199 35 969

(51) Int. Cl.[7] ..... H01R 31/08
(52) U.S. Cl. ..... 439/507
(58) Field of Search ..... 439/507, 511, 439/509, 510, 513, 512, 188, 352, 680, 620; 200/51.1

(56) References Cited

U.S. PATENT DOCUMENTS 4,152,041 A * 5/1979 Hollyday et al. ..... 439/147 P
5,334,025 A * 8/1994 Fohl ..... 439/188
5,847,914 A * 12/1998 Johansen et al. ..... 361/111
5,895,282 A * 4/1999 Little ..... 439/33
5,921,810 A * 7/1999 Murakoshi ..... 439/510
6,217,388 B1 * 4/2001 Francis ..... 439/620

FOREIGN PATENT DOCUMENTS

DE 19514864 A1 11/1998
DE 19851301 11/1998
EP 0591947 A2 4/1994

* cited by examiner

*Primary Examiner*—Gary Paumen
*Assistant Examiner*—Phuongchi Nguyen
(74) *Attorney, Agent, or Firm*—Perman & Green, LLP

(57) ABSTRACT

The invention specifies a shorting contact support for an igniter receptacle (70), comprising a shorting bridge (19) having at least two resilient contact elements (20, 21) for electrically connecting contact pins on the igniter (2) and having at least one first metal plate (23), and a support housing (9) having an annular base (3) on which two diametrically opposite wings (4, 5) are integrally formed parallel to the insertion direction, so that a plug-in projection (13) can be inserted between said wings. The shorting bridge (19) has a second metal plate (24), the two metal plates (23, 24) being essentially parallel opposite one another and being connected to one another in view of at least one ring segment (37, 38). At least one of the plates (23) has at least one contact tongue (22) so that it is electrically connected to a screening or earth connection (68) situated on the plug when the plug is inserted into the ignition receptacle (70).

17 Claims, 4 Drawing Sheets

SHORTING CONTACT SUPPORT FOR IGNITER RECEPTACLES

BACKGROUND OF THE INVENTION

1. Field of the Invention

The present invention relates to a shorting contact support for ignition receptacles, and more particularly to contact supports as used in airbag restraining systems for motor vehicles.

2. Description of the Prior Art

The igniter and the electrical supply lines for such airbag restraining systems can be accommodated on the front in the hub cushion of the steering wheel. In this case, the electrical connection between the igniter and the control system is a very sensitive point in the restraining system, since any uncontrolled fluctuations in potential which arise on the igniter's contact pins can result in the airbag being triggered unintentionally.

For this reason, known plug connector systems have a shorting bridge in the igniter's ignition receptacle and between the igniter's contact pins, said shorting bridge being released from these contact pins on insertion of the plug's plug-in projection if electrical contact has already been made between the plug sockets and contact pins. During the insertion procedure, such a shorting bridge effectively prevents the igniter from being unintentionally triggered by electrostatic energy which may have accumulated in the region of the igniter.

The document EP 0 591 947 describes a plug connector having such a shorting bridge, which has been designed such that the shorting bridge is arranged in a shorting contact support.

A particular disadvantage of such shorting contact supports is that, once the plug-in projection has been inserted into the holder in the shorting contact support, the shorting bridge is lifted from the igniter's contact pins without providing any further protection against electromagnetic interference or electrostatic charges between the contact pin and contact eye connection. One occurrence during the insertion procedure may be that the shorting contact support or the ignition receptacle with its contact pins is at a different potential from that of the plug-in projection with its contact sleeves. A further disadvantage in this case is that this potential difference can be compensated for only by screening on the contact pins and contact sleeves, or else the electrical energy is dissipated by means of the control electronics connected to the contact sleeves of the contact plug. In this case, an insertion procedure may damage the control electronics.

The document DE 198 51 301 discloses an electrical plug connector for igniters which comprises a housing and a plug-in projection which is integrally formed on the housing and has, along the insertion direction of the plug connector, contact elements for engaging with corresponding mating pieces in a connector part, and at least one guide element for engaging in a complementary part, the screening device having an electrically conductive earthed ring which is arranged around the contact elements, and contact tongues for dissipating electrical charge in the connector part. A particular disadvantage of this plug connector is that it provides no possibility for shorting the igniter's contact pins. Furthermore, this plug connector is suitable only for "intelligent" igniters, which means that the igniters have dedicated control electronics.

SUMMARY OF THE INVENTION

The object of the present invention is to present a shorting contact support which is suitable both for intelligent and non-intelligent igniters. In addition, the aim is to improve the protection of the electrical connection between the contact pins in the igniter receptacle and the contact sleeves on the plug against electrostatic charge and electromagnetic interference.

The object is achieved by the features of the present invention.

The inventive shorting contact support for igniter receptacles comprises a shorting bridge having at least two resilient contact elements for electrically connecting contact pins on an igniter, the shorting bridge also having at least one first plate. In addition, the shorting contact support comprises a support housing having an annular base in which two diametrically opposite wings are integrally formed parallel to the insertion direction, so that a plug-in projection can be inserted between said wings. In this arrangement, the shorting bridge has a second metal plate, the two metal plates being essentially parallel opposite one another and being connected to one another by means of at least one ring segment. Furthermore, at least one of the plates has at least one contact tongue so that it is electrically connected to a screening or earth connection situated on the plug when the plug is inserted into the ignition receptacle.

In the case of such a shorting contact support, a particularly advantageous feature is that, when the plug-in projection is inserted into the shorting contact support, the shorting bridge can be pulled to earth with the contact pins on the igniter, that is to say they are at a defined potential and any electrostatic charges can flow away via this earth.

One advantageous refinement of the invention is that the lateral edges of the metal plates form cutting contacts which, in the assembled state, project laterally from the wings. What is special about this is that, when the shorting contact bridge is inserted into the metallized igniter receptacle, the latter is automatically earthed as well, this metallization operating as a Faraday cage.

DESCRIPTION OF THE DRAWINGS

An illustrative embodiment of the invention is shown in the schematic drawing and is described in more detail below, where further special features and advantages of the invention are revealed. In the drawing.

DESCRIPTION OF THE PREFERRED EMBODIMENTS

Figure 1:
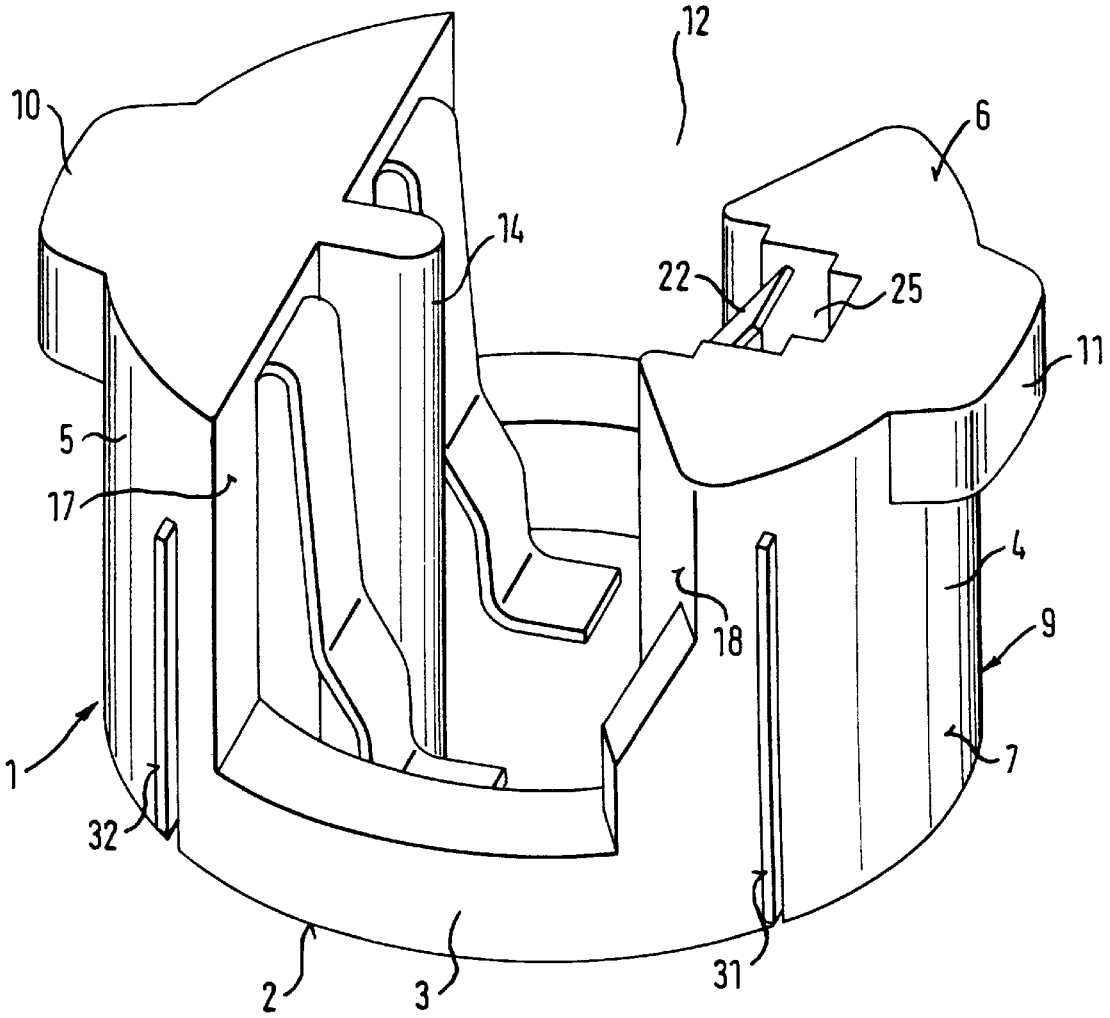
FIG. 1 shows an oblique view of an inventive shorting contact support.
Figure 2:
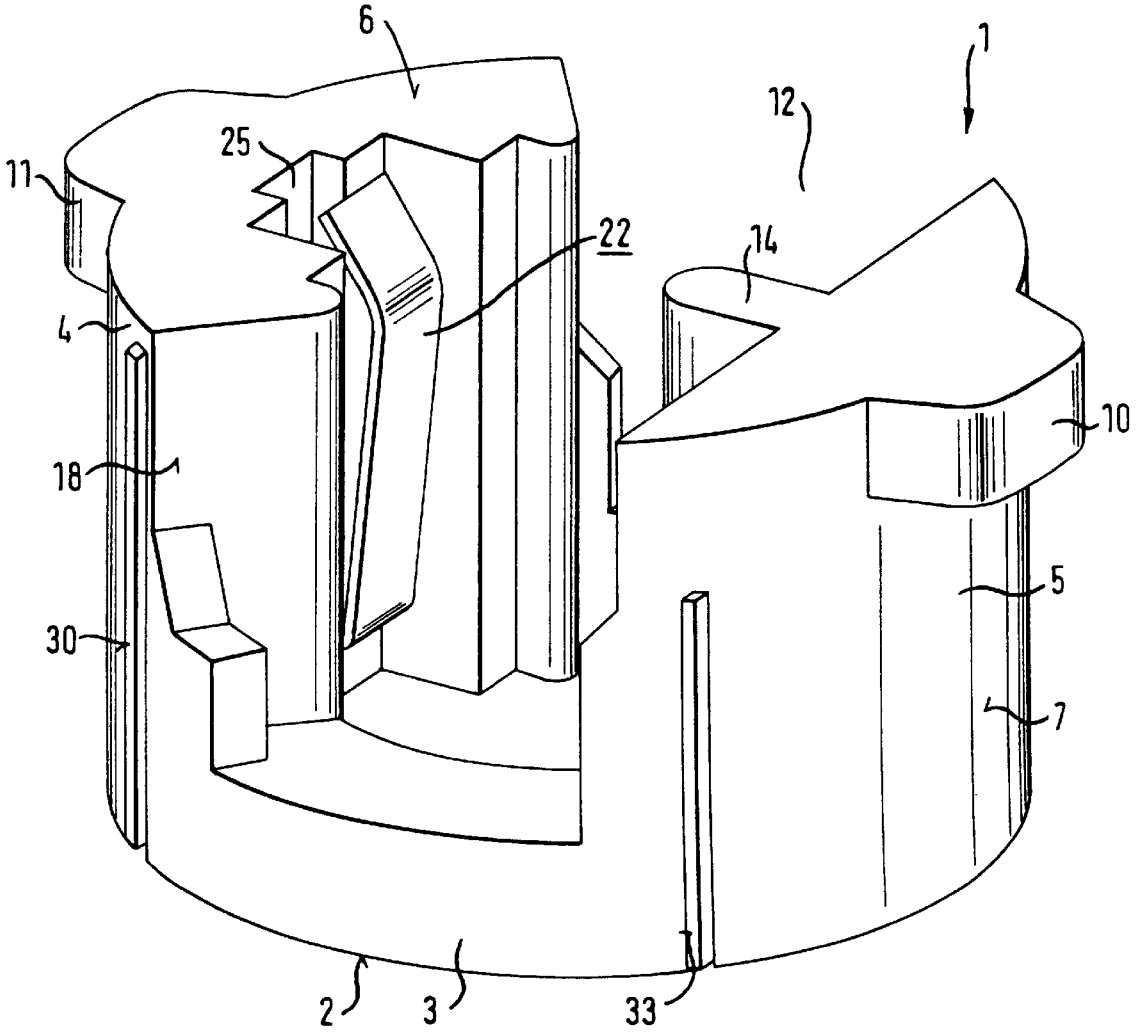
FIG. 2 shows an oblique view of an inventive shorting contact support as shown In FIG. 1, rotated through 180°.

FIGS. 1 and 2 show an oblique view of an inventive shorting contact support. On its back 2, this shorting contact support 1 has an annular base 3 on which two diametrically opposite wings 4 and 5 running in the plug-in direction are integrally foxed, the circumferential surface of the wings being cylindrical. On the circumferential surface 7 of each wing 3 and 4, a respective semicircular lobe 10 and 11 for coding purposes is integrally formed on the front 6 of the shorting contact support so as to be directed outwards. The two wings 4 and 5 frame a holder 12 for the plug-in projection 13, one of the wings 5 having a guide shoulder 14 which is inwardly directed into the holder 12 and extends in the plug-in direction and over the overall height of the wing. In this case, this guide shoulder 14 is integrally formed essentially in the centre of the wing 5, so that, once the shorting bridge 19 has been inserted into the support housing 9, a respective contact element 20 and 21 of the shorting bridge 19 is arranged on either side of the guide shoulder 14 along the inwardly directed wall 17 of the wing 5. On the other side of the holder 12, a groove 25 in the inwardly directed side 18 of the other wing 4 is made over the overall height of the wing, along the insertion direction, in order to accommodate a contact tongue 22. Each wing 4 and 5 accommodates a respective metal plate 23 and 24 of the shorting bridge 19, with the edges 30, 31, 32 and 33 (running parallel to the insertion direction) of the two metal plates 23 and 24 projecting from the cylindrical circumferential surface 7 of the wings.

Figure 3:
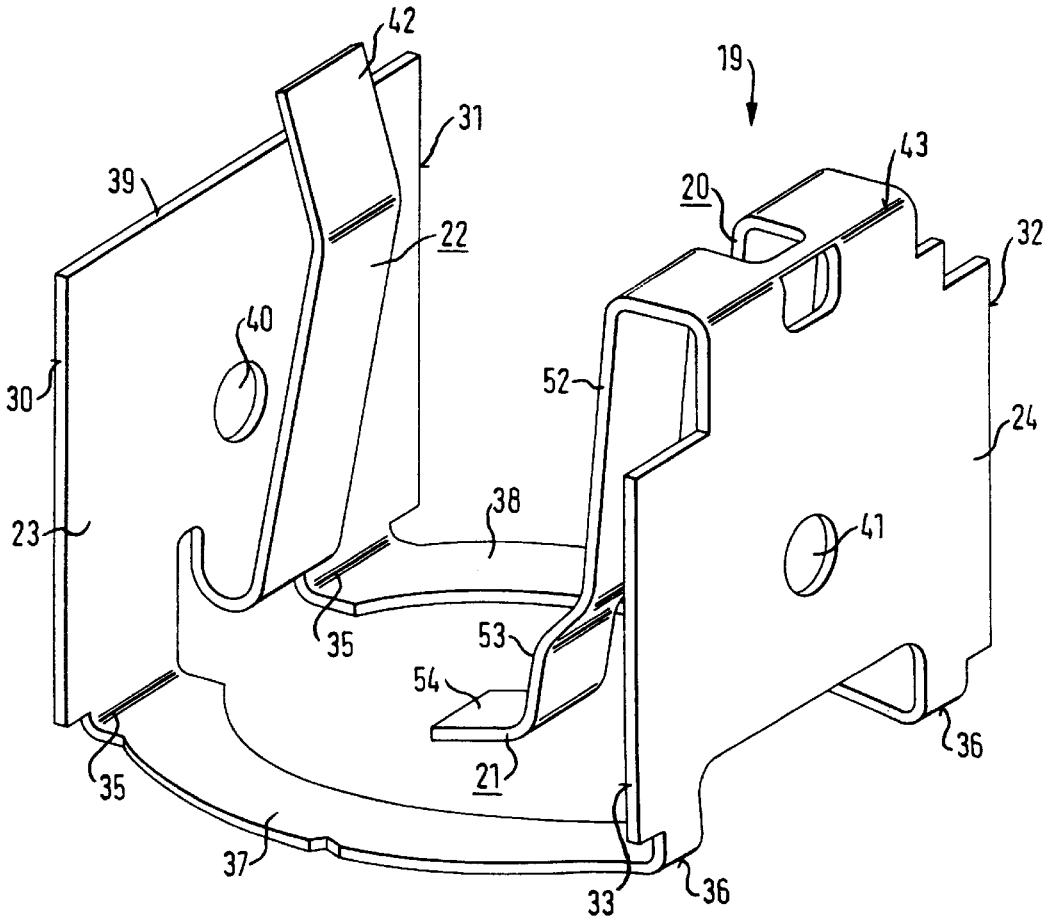
FIG. 3 shows an oblique view of a shorting bridge fitted in the shorting contact support shown in FIGS. 1 and 2.

The shorting bridge 19 is described in more detail below with reference to FIG. 3. The shorting bridge 19 has two essentially rectangular metal plates 23 and 24 which are arranged parallel to one another and are connected at their bottom edges at a distance from one another by means of a conductive, ring segment and 38. The ring segments 37 and 38 have the same curvature as the annular base 3, so that these shallow ring segments can lie on the base. In the centre of the two shallow metal plates 23 and 24 there are respective holes 40 and 41 for holding a pin situated in the support housing 9. Integrally formed on the top edge 43 of the right-hand shallow metal plate 24 are the two contact elements 20 and 21. The starting region S1 of the contact elements 21 and 20 runs inwards at right angles to the metal plate 24, This starting region is extended by a central region 52 which is directed at right angles to it and runs essentially parallel to the metal plate 24. From the top edge 43 of the right-hand metal plate 24, the two contact elements 20 and 21 extend slightly inwards, bend away and run essentially parallel to the bottom edge 36 of the plate 24. Integrally formed on this central part 52 of the contact element is an inwardly directed bend 53 which merges into an end region 54, said end region being directed essentially at right angles to the other plate 23. The two contact elements 20 and 21 run essentially parallel to one another and have the same profile.

Integrally formed on the bottom edge 35 of the other metal plate 23 is the contact tongue 22, which is bent slightly inwards essentially from the bottom edge 35 and from there points to the top edge 39 and in fact runs beyond it. The bottom region 42 of the contact tongue 22 is bent slightly towards the metal plate 23.

This complete shorting bridge 19 is pushed into the support housing 9 from the bottom side 2 in such a way that one metal plate 23 is fully inserted in the wing 4 up to the cutting contacts 30 and 31. Likewise, the other metal plate 24 is accommodated fully by the wing 5 up to the cutting contacts 33 and 32. so that the contact element 20 is arranged on one side of the guide shoulder and the contact element 21 is arranged on the other side of the guide shoulder. It should be noted here that the end 42 of the contact tongue 22 points towards the front of the support housing. The end regions of the contact elements 20 and 21 point towards the base 3.

An example of use is explained briefly below with the aid of FIG. 4. Before that, however, a more precise description will be given of a plug-in projection on a plug.

Figure 4:
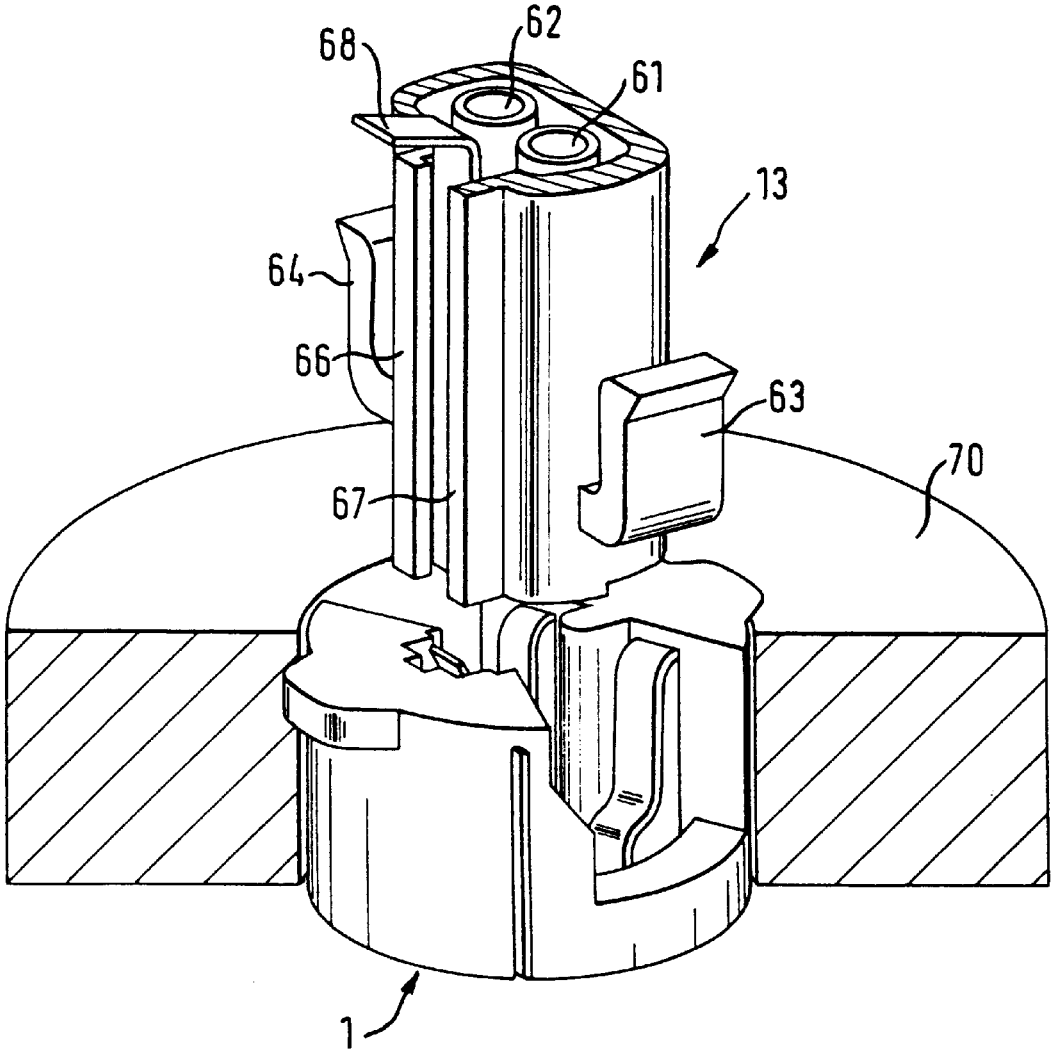
FIG. 4 shows an oblique view of a partially cut-away igniter receptacle containing an inventive shorting contact support, above which there is a plug-in projection shortly before insertion.

FIG. 4 shows a plug-in projection 13 cut away transversely with respect to the insertion direction. Inside its housing, this plug-in projection has two contact sleeves 61 and 62 which are fully accommodated in the plug-in projection 13 in the plug-in direction. On its width sides, the essentially rectangular plug-in projection has latching tongues 63 and 64 running essentially in the plug-in direction. On one length side of the plug-in projection 13, two guide shoulders 66 and 67 are integrally formed over the overall length of the plug-in projection such that they accommodate the earth connection 68 between them and the distance between the guide shoulders 66 and 67 matches the groove 25 in the support housing 9.

When connecting an airbag to its control electronics, the shorting contact support 1 first needs to be inserted into the igniter receptacle 70, and the metal cutting edges 30 to 33 cut into the inner surface of the igniter receptacle in order to produce a connection which is mechanically difficult to separate. The contact elements 20 and 21 are then touching the contact pins of the igniter receptacle 70, so that they are shorted. Next, the plug-in projection 13 needs to be inserted into the holder 12 in the shorting contact support 1. The contact tongue 22 then passes between the guide shoulders 66 and 67 and touches the earth connection 66, so that the shorting bridge and the contact pins of the igniter receptacle are earthed. Only after that do the contact sleeves 61 in the plug-in projection 13 make contact with the igniter receptacle's contact pins. As the plug is pushed in fully, the latching arms 63 and 62 latch accordingly in cutouts made in the igniter receptacle 70, and the plug-in projection can interrupt the shorting bridge. Such a restraining system is then ready for use.

What is claimed is:

1. Shorting contact support assembly for an igniter receptacle comprising:

a shorting bridge having at least two resilient contact elements for electrically connecting contact pins on the igniter and having at least one first metal plate, and a support housing having an annular base on which two diametrically opposite wings are integrally formed parallel to an insertion direction, whereby a plug-in projection can be inserted between the wings, wherein the shorting bridge includes a second metal plate, the first and second metal plates being essentially parallel and opposite one another, and being connected to one another by means of at least one ring segment, and further at least one of the plates having at least one contact tongue so that it is electrically connected to a screening or earth connection situated on a plug when the plug is inserted into the ignition receptacle, the contact tongue being a third resilient contact element that is separate from the at least two resilient contact elements.

2. Shorting contact support assembly according to claim 1, wherein said wings are enveloped y a cylinder shape, a respective lobe being integrally formed on the front of said wings on the outside.

3. Shorting contact support assembly according to claim 1, wherein a central region of said contact elements run essentially parallel to said plate, an end region of said contact elements run essentially transversely with respect to said insertion direction, and further that said contact elements each have an inwardly directed corner between the central region and the end region.

4. Shorting contact support assembly according to claim 1, wherein at least one of said plates has a hole for holding a pin integrally formed in said wings.

5. Shorting contact support assembly according to claim 1, wherein said two metal plates are connected to one another by means of two diametrically opposite ring segments.

6. Shorting contact support assembly according to claim 1, wherein in the assembled state, said metal plates are situated in said wings and said ring segments rest on said base.

7. Shorting contact support assembly according to claim 6, wherein lateral edges of said metal plates form cutting contacts which, in the assembled state, project laterally from said wings.

8. Shorting contact support assembly according to claim 1, wherein said bottom edges of said essentially rectangular metal plates are connected to said ring segments, said contact tongue being integrally formed close to a bottom edge of one of said metal plates, and said two contact elements being integrally formed close to a top edge of said other metal plate.

9. Shorting contact support assembly according to claim 8 wherein said contact tongue is bent from said bottom edge inwards towards its top edge, and further wherein said contact elements are bent from said top edge of said other metal plate inwards towards its bottom edge.

10. Shorting contact support assembly for an igniter receptacle comprising:

a shorting bridge having at least two resilient contact elements for electrically connecting contact pins on the igniter and having at least one first metal plate, and a support housing having an annular base on which two diametrically opposite wings are integrally formed parallel to an insertion direction, whereby a plug-in projection can be inserted between the wings, wherein the shorting bridge includes a second metal plate, the first and second metal plates being essentially parallel and opposite one another, and being connected to one another by means of at least one ring segment, and further at least one of the plates having at least one contact tongue so that it is electrically connected to a screening or earth connection situated on a plug when the plug is inserted into the ignition receptacle, and further wherein in the assembled state, the metal plates are situated in the wings and the ring segments rest on the base.

11. Shorting contact support assembly according to claim 10, wherein said wings are enveloped by a cylinder shape, a respective lobe being integrally formed on the front of said wings on the outside.

12. Shorting contact support assembly according to claim 10, wherein lateral edges of said metal plates form cutting contacts which, in the assembled state, project laterally from said wings.

13. Shorting contact support assembly according to claim 10, wherein a central region of said contact elements run essentially parallel to said plate, an end region of said contact elements run essentially transversely with respect to said insertion direction, and further that said contact elements each have an inwardly directed corner between the central region and the end region.

14. Shorting contact support assembly according to claim 10, wherein at least one of said plates has a hole for holding a pin integrally formed in said wings.

15. Shorting contact support assembly according to claim 10, wherein said two metal plates are connected to one another by means of two diametrically opposite ring segments.

16. Shorting contact support assembly according to claim 10, wherein said bottom edges of said essentially rectangular metal plates are connected to said ring segments, said contact tongue being integrally formed close to a bottom edge of one of said metal plates, and said two contact elements being integrally formed close to a top edge of said other metal plate.

17. Shorting contact support assembly according to claim 16, wherein said contact tongue is bent from said bottom edge inwards towards its top edge, and further wherein said contact elements are bent from said top edge of said other metal plate inwards towards its bottom edge.

* * * * *